United States Patent [19]

D'Errico

[11] Patent Number: 4,522,785

[45] Date of Patent: Jun. 11, 1985

[54] DIALKYLAMINOMETHYL AROMATIC TRIAZOLES AS CORROSION INHIBITORS

[75] Inventor: Michael J. D'Errico, Flossmoor, Ill.

[73] Assignee: The Sherwin-Williams Company, Cleveland, Ohio

[21] Appl. No.: 439,110

[22] Filed: Nov. 4, 1982

[51] Int. Cl.[3] ..... C23F 11/04

[52] U.S. Cl. ..... 422/12; 252/390; 252/392

[58] Field of Search ..... 548/257, 259, 260, 261; 422/12; 252/49.3, 50, 51.5 A, 390, 392

[56] References Cited

U.S. PATENT DOCUMENTS

| | | | |
|---|---|---|---|
| 3,791,803 | 2/1974 | Andress et al. | 44/63 |
| 3,985,503 | 10/1976 | O'Neal, Jr. | 252/392 X |
| 4,086,242 | 4/1978 | Diehl et al. | 548/257 X |
| 4,177,155 | 12/1979 | Popplewell et al. | 252/49.3 |
| 4,212,754 | 7/1980 | Chibnik | 252/49.7 |

FOREIGN PATENT DOCUMENTS

| | | | |
|---|---|---|---|
| 79236 | 5/1983 | European Pat. Off. | 252/392 |
| 1061904 | 3/1967 | United Kingdom | 252/390 |
| 1065995 | 4/1967 | United Kingdom | 252/390 |
| 1511593 | 5/1978 | United Kingdom | 548/257 |
| 1514359 | 6/1978 | United Kingdom | 252/392 |

OTHER PUBLICATIONS

Burckhalter, et al., "Proof of Structures Derived from the Hydroxy- and Amino-Methylation of Benzotriazole", *J. Amer. Chem. Soc.*, vol. 74, pp. 3868-3870, (1952).

*Primary Examiner*—Edward A. Miller
*Assistant Examiner*—Matthew A. Thexton
*Attorney, Agent, or Firm*—Robert E. McDonald; James V. Tura

[57] ABSTRACT

This invention involves a process for minimizing corrosion of metals in contact with aqueous acid solutions wherein said process comprises adding to the aqueous acid solution a corrosion inhibiting amount of a dialkylaminomethyl aromatic triazole having the structure:

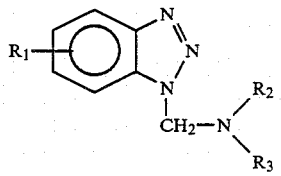

wherein $R_1$ is from 1 to 4 substituents and is hydrogen, aliphatic of 1 to about 12 carbons, alkoxy of 2 to about 10 carbons, aroxy of 2 to about 10 carbons, or —$COOR_4$ wherein $R_4$ is aliphatic of 1 to about 12 carbons; and $R_2$ and $R_3$ are the same or different and are alkyl of 1 to about 4 carbons.

16 Claims, No Drawings

DIALKYLAMINOMETHYL AROMATIC TRIAZOLES AS CORROSION INHIBITORS

BACKGROUND OF THE INVENTION

1. Field of the Invention

This invention relates to a process for inhibiting corrosion, and, in one of its aspects, relates more particularly to inhibiting the corrosion of steel, especially steel exposed to an aqueous acidic environment. The process of this invention involves the use of an inhibiting amount of a dialkylaminomethyl aromatic triazole.

2. Description of the Prior Art

Various 1,2,3-benzotriazoles have been used as corrosion inhibitors, chemical intermediates, fungicides, catalysts, plant growth regulators, and anti-tarnish agents. One of the difficulties in utilizing triazoles is their relatively limited solubility in acidic environments. The dialkylaminomethyl aromatic triazoles of this invention have excellent corrosion inhibiting properties even in acidic solutions.

The manufacture of dialkylaminomethyl aromatic triazoles by a Mannich condensation of an aromatic triazole, formaldehyde and a secondary amine has been described in the *Journal of the American Chemical Society,* Volume 74, Page 3868 (Burckhalter et al.). This procedure was done merely to identify the structure of the benzotriazoles and provides no indication of utility of the product.

BRIEF SUMMARY OF THE INVENTION

Metals such as brass, copper, aluminum, steel and others are subject to rapid corrosion when placed in contact with aqueous solutions such as cooling water, anti-freeze, or aqueous acid solutions such as used in steel pickling or encountered in drilling processes.

It is therefore an object of this invention to provide a process for inhibiting the corrosion of metals exposed to an aqueous acidic corrosive environment by the addition of an inhibiting amount of a dialkylaminomethylbenzotriazole to the aqueous solution. A more limited object of this invention is to provide a process for minimizing corrosion of ferrous metals exposed to corrosive environments. A more specific object of this invention is to provide a process for minimizing the corrosion of metals, especially ferrous metals, exposed to an aqueous acidic environment.

DETAILED DESCRIPTION OF THE INVENTION

This invention involves a process for reducing corrosion of metals in contact with an aqueous acidic solution which comprises adding to the aqueous acid solution a corrosion inhibiting amount of dialkylaminomethyl aromatic triazole having the structure:

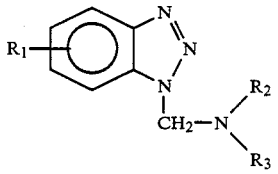

wherein $R_1$ is from 1 to 4 substituents and is hydrogen, aliphatic of 1 to about 12 carbons, alkoxy of 2 to about 10 carbons, aroxy of 2 to about 10 carbons, or —$COOR_4$ wherein $R_4$ is aliphatic of 1 to about 12 carbons; and $R_2$ and $R_3$ are the same or different and are alkyl of 1 to about 4 carbons. As used herein, the term aqueous acidic solution means any aqueous solution having a pH less than about 7.0.

The dialkylaminomethylbenzotriazoles of this invention can be conveniently prepared by the reaction of aromatic triazoles, formaldehyde and a secondary amine. It is generally preferrable to use a slight stoichiometric excess (usually about 10 to 20% excess) of the formaldehyde and the amine. The reaction is conveniently conducted by mixing the triazole and the secondary amine in a suitable inert solvent and optionally water, and cooling the mixture in an ice bath. The formaldehyde is conveniently added as an aqueous solution in a drop-wise manner into the cooled mixture. The reaction is very thermodynamically favorable and can conveniently be run at room temperature or less. The preparation of the dialkylaminomethyl aromatic triazoles, shown representatively with benzotriazole, formaldehyde and dimethyl amine would be:

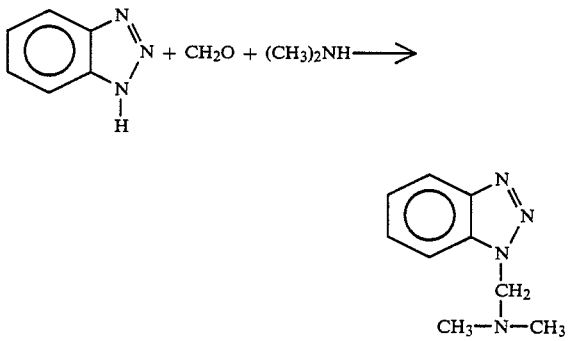

The secondary amines used in the reaction are preferably amines having alkyl groups of 1 to about 4 carbons. Representative amines which are useful in the practice of this invention include ethylbutylamine, methylpropylamine, methyl isobutylamine, dimethylamine, and so forth. Especially preferred in the practice of this invention is dimethylamine due to its availability and low molecular weight.

The aromatic triazoles which can be reacted with the secondary amine are commercially available or they may be readily prepared by techniques well-known in the art. Typically triazoles are prepared by the diazotization of 1,2 aromatic amines. For example, the preparation of benzotriazole by the diazotization of 1,2-diaminobenzene with nitrous acid is taught in *Organic Synthesis,* Volume 20, Pages 16–18 (1940), U.S. Pat. No. 3,227,726 and U.S. Pat. No. 3,564,001. The preparation of substituted benzotriazoles by diazotization of substituted diamines is taught in U.S. Pat. Nos. 2,861,078; 3,413,227 and British Pat. No. 1,065,995. Tolyltriazoles (either 4-or 5-methyl) can be easily prepared from 2,3 or 3,4-diaminotoluene by diazotization as taught in U.S. Pat. Nos. 3,732,239 or 3,970,667. The preparation of benzotriazole carboxylic acids and their esters by diazotization of a 3,4-diaminocarboxylic acid is taught in U.S. Pat. No. 4,187,186. The production of alkylbenzotriazoles from alkyl substituted aniline is taught in Netherlands application No. 6,414,144 June 8, 1965.

Especially preferred in the practice of this invention are the 4- or 5- alkyl or ester substituted dimethylaminomethylbenzotriazoles. Preferred triazoles include 1-dimethylaminomethylbenzotriazole, 1-(dimethylaminomethyl)-4-methyl-benzotriazole, 1-(dimethylaminomethyl)-5-methyl-benzotriazole, 1-(dimethylaminomethyl)-4-dodecyl-benzotriazole, 1-(dimethylaminomethyl)-5-dodecyl-benzotriazole, and 1-(dialkylaminomethyl)-5-carboxymethylbenzotriazole.

The process of this invention is especially useful in minimizing corrosion of metals such as brass, copper, aluminum and steel in contact with aqueous acid solutions. The amount of the dialkylaminomethyl aromatic triazole which must be added to the aqueous solution will vary depending upon the nature of the metal, and the nature of the aqueous acid corrosive environment and it is only necessary that enough of the dialkylaminomethyl aromatic triazole be incorporated to inhibit or minimize corrosion. Typically, the aromatic triazole will be present at a level of at least about 1 part triazole per 1 million parts by weight of the aqueous acid solution and normally the triazole will be present at a level between about 1 to about 50,000 parts by weight triazole per 1 million parts of the aqueous acid solution. Especially preferred is a level between about 200 and 2000 parts by weight of the dialkylaminomethyl aromatic triazole per 1 million parts of the aqueous solution. Within the process of this invention, the dialkylaminomethyl aromatic triazole may be added directly into the aqueous acid solution or the triazole may be dissolved in water (especially as an acid salt such as the hydrochloric acid salt) or a suitable inert solvent and then added to the aqueous acid solution. When the process of this invention is applied to minimize corrosion in drilling equipment, the dialkylaminomethyl aromatic triazole can be added as an aqueous solution to the drilling mud which is circulated into the hole. This procedure is useful to prevent corrosion when the drilling equipment contacts pockets of acidic solutions, such as aqueous hydrogen sulfide solutions while drilling.

The aqueous acid solution may also contain other additives such as other corrosion inhibitors, antioxidants, scale inhibitors, biocides, dispersants, colorants, etc.

Similarly, the dialkylaminomethyl benzotriazoles of this invention could be used to minimize corrosion of metals in contact with aqueous alkaline solutions or with synthetic or natural polymeric materials such as rubber, synthetic ester lubricants, polyethylene, polypropylene, polystyrene, mineral oils, greases, synthetic hydrocarbons, hydraulic fluids, and transmission fluids.

The following examples are illustrative of the process of this invention:

EXAMPLE 1

A reaction flask was placed in an ice/water bath and charged with 4.76 grams benzotriazole, 5.0 mls of a 40% solution of dimethylamine in water, 60 mls methanol, and 20 mls water. 4.4 mls of a 37% solution of formaldehyde in water was then added drop-wise to the cooled mixture over a 10 minute period. The stirring continued for 30 minutes after which the ice bath was removed and the reaction mixture was allowed to stand overnight at room temperature. The methanol was then distilled off leaving a white crystal precipitate. The crystals were filtered, washed with water and then dried in a vacuum desiccator for about 4 hours. Infrared analysis indicated the product was 1-dimethylaminomethylbenzotriazole.

This product can be dissolved as a dilute solution in water and conveniently added to drilling mud to minimize corrosion of metal drilling equipment in contact with solutions of aqueous hydrogen sulfide.

EXAMPLE 2

The process of Example 1 was repeated substituting 5.32 grams Cobratec® TT-100 (mixture of 3- and 4-tolyltriazole commercially available from The Sherwin-Williams Company) for the benzotriazole. The product was identified as a mixture of 1-(dimethylaminomethyl)-4-methyl-benzotriazole and 1-(dimethylaminomethyl)-5-methyl-benzotriazole.

EXAMPLE 3

The procedure of Example 1 was repeated substituting 4.36 grams of dodecylbenzotriazole (a mixture of 3- and 4-dodecylbenzotriazole) for the benzotriazole and reducing all other reagents to one-half of their original quantity. The product was identified as a mixture of 1-(dimethylaminomethyl)-4-dodecyl-benzotriazole and 1-(dimethylaminomethyl)-5-dodecyl-benzotriazole.

EXAMPLE 4

Following the procedure of Example 1, 7.08 grams 5-carboxymethyl-benzotriazole, 5.0 mls of a 40% solution of dimethylamine in water, 60 mls methanol and 20 mls water were mixed and cooled in an ice bath. 4.4 mls of a 37% solution of formaldehyde in water was slowly added to the cooled mixture. The mixture was then stirred at room temperature for about 4 hours. The solid product was filtered, washed with water and dried. The product was identified as 1-(dimethylaminomethyl)-5-carboxymethyl-benzotriazole.

The carboxymethylbenzotriazole can be conveniently prepared using the procedure taught in U.S. Pat. No. 4,187,186 wherein a large excess of methanol is saturated with hydrogen chloride and refluxed with 3,4-diaminobenzoic acid.

EXAMPLE 5

In order to test the corrosion inhibiting characteristics of these materials, a number of steel coupons were cleaned and dried and accurately weighed. Each coupon was immersed in 300 grams of 5% aqueous hydrochloric acid at 75° C. The coupons were maintained for 4 hours at 75° C. then removed from the bath, brushed under running water, rinsed with acetone, dried and placed in a desiccator overnight. The tests were conducted with and without the addition of an inhibitor in the aqueous acid solutions. The percentage weight loss of the coupons is shown in the table below:

| Inhibitor Example No. | Parts Inhibitor/ 300 Grams 5% HCL | Percent Weight Loss |
|---|---|---|
| Control | 0.0 | 18.80% |
| 2 | .150 grams | 1.15% |
| 3 | .150 grams | 2.85% |
| 4 | .300 grams | 0.60% |

The foregoing examples, are merely illustrative of this invention, and it is obvious that other variations and modifications may be made without departing from the spirit and scope of the invention as set forth in the appended claims.

The invention claimed is:

1. A process for reducing the corrosion of ferrous metals in contact with aqueous acidic solutions wherein said process comprises adding to the aqueous acidic solution a corrosion inhibiting amount of a dialkylaminomethyl aromatic triazole having the structure:

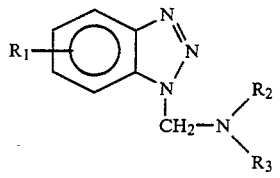

wherein $R_1$ is from 1 to 4 substituents and is hydrogen, aliphatic of 1 to about 12 carbons, alkoxy of 2 to about 10 carbons, aroxy of 2 to about 10 carbons, or —$COOR_4$ wherein $R_4$ is aliphatic of 1 to about 12 carbons; and $R_2$ and $R_3$ are the same or different and are alkyl of 1 to about 4 carbons.

2. The process of claim 1 further characterized in that the aromatic triazole is 1-dimethylaminomethylbenzotriazole.

3. The process of claim 1 further characterized in that the aromatic triazole is 1-(dimethylaminomethyl)-4-methyl-benzotriazole.

4. The process of claim 1 further characterized in that the aromatic triazole is 1-(dimethylaminomethyl)-5-methyl-benzotriazole.

5. The process of claim 1 further characterized in that the aromatic triazole is 1-(dimethylaminomethyl)-4-dodecyl-benzotriazole.

6. The process of claim 1 further characterized in that the aromatic triazole is 1-(dimethylaminomethyl)-5-dodecyl-benzotriazole.

7. The process of claim 1 further characterized in that the aromatic triazole is 1-(dimethylaminomethyl)-5-carboxymethyl-benzotriazole.

8. The process of claim 1 further characterized in that the aromatic triazole is added at a level of at least about 1 part triazole per 1 million parts by weight aqueous solution.

9. The process of claim 1 further characterized in that the aromatic triazole is present at a level of between about 1 to 50,000 parts by weight triazole per 1 million parts aqueous solution.

10. A process for minimizing the corrosion of steel in contact with an aqueous acid solution which process comprises adding to the aqueous acid solution about 1 to about 50,000 parts by weight per 1 million parts of the aqueous acid solution, a dialkylaminomethyl aromatic triazole having the structure:

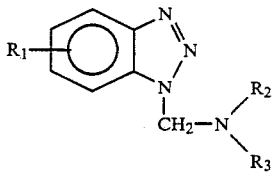

wherein $R_1$ is from 1 to 4 substituents and is hydrogen, aliphatic of 1 to about 12 carbons, alkoxy of 2 to about 10 carbons, aroxy of 2 to about 10 carbons, or —$COOR_4$ wherein $R_4$ is aliphatic of 1 to about 12 carbons; and $R_2$ and $R_3$ are the same or different and are alkyl of 1 to about 4 carbons.

11. The process of claim 10 further characterized in that the aromatic triazole is 1-(dimethylaminomethylbenzotriazole.

12. The process of claim 10 further characterized in that the aromatic triazole is 1-(dimethylaminomethyl)-4-methylbenzotriazole.

13. The process of claim 10 further characterized in that the aromatic triazole is 1-(dimethylaminomethyl)-5-methylbenzotriazole.

14. The process of claim 10 further characterized in that the aromatic triazole is 1-(dimethylaminomethyl)-4-dodecylbenzotriazole.

15. The process of claim 10 further characterized in that the aromatic triazole is 1-(dimethylaminomethyl)-5-dodecylbenzotriazole.

16. The process of claim 10 further characterized in that the aromatic triazole is 1-(dimethylaminomethyl)-5-carboxymethylbenzotriazole.

* * * * *